United States Patent [19]

Nakajima

[11] Patent Number: 4,818,189

[45] **Date of Patent: * Apr. 4, 1989**

[54] VARIABLE CAPACITY VANE COMPRESSOR

[75] Inventor: Nobuyuki Nakajima, Saitama, Japan

[73] Assignee: Diesel Kiki Co., Ltd., Tokyo, Japan

[ * ] Notice: The portion of the term of this patent subsequent to Oct. 18, 2005 has been disclaimed.

[21] Appl. No.: 931,217

[22] Filed: Nov. 14, 1986

[30] Foreign Application Priority Data

Nov. 28, 1985 [JP] Japan ..... 60-268137

[51] Int. Cl.[4] ..... F04B 49/02; F04C 29/08

[52] U.S. Cl. ..... 417/295; 417/310

[58] Field of Search ..... 417/295, 310, 440; 418/15, 78

[56] References Cited

U.S. PATENT DOCUMENTS

| | | | |
|---|---|---|---|
| 3,120,814 | 2/1964 | Mueller | 417/310 |
| 3,206,218 | 9/1965 | Potter et al. | 91/482 |
| 3,451,614 | 6/1969 | Tosh | 417/440 |
| 3,515,496 | 6/1970 | Eddy | 417/440 |
| 3,799,707 | 3/1974 | Newton | 418/78 |
| 4,060,343 | 11/1977 | Newton | 417/310 |
| 4,272,227 | 6/1981 | Woodroff | 418/185 |
| 4,557,670 | 12/1985 | Inagaki | 417/299 |
| 4,566,869 | 1/1986 | Pandeya | 418/15 |
| 4,726,740 | 2/1988 | Suzuki et al. | 417/292 |

FOREIGN PATENT DOCUMENTS

| | | | |
|---|---|---|---|
| 552000 | 1/1980 | Japan . | |
| 137813 | 2/1984 | Japan | 417/270 |
| 196991 | 11/1984 | Japan | 417/310 |
| 61-232397 | 10/1986 | Japan . | |

*Primary Examiner*—William L. Freeh

*Attorney, Agent, or Firm*—Frishauf, Holtz, Goodman & Woodward

[57] ABSTRACT

An improved variable capacity vane compressor comprises at least one second inlet port formed in a rear side block of the cylinder and communicating a suction chamber with at least one of compression chambers on a suction stroke, defined within the cylinder, and an opening angle control device arranged in the rear side block for varying the opening angle of the at least one second inlet port. The opening control device has a pressure receiving portion defining a first pressure chamber supplied with a high pressure and a second pressure chamber supplied with a low pressure, both arranged in the rear side block, and being angularly displaceable in response to a difference between the high pressure and the low pressure for causing the opening angle control device to vary the opening angle of the at least one second inlet port. A pressure control device is arranged in the rear side block and the rear head and responsive to at least one parameter representative of a thermal load on the compressor for varying at least one of the high and low pressures in the first and second pressure chambers.

10 Claims, 14 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automotive vehicles.

A variable capacity vane compressor is known e.g. by Japanese Provisional Utility Model Publication No. 55-2000 filed by the same assignee of the present application, which is capable of controlling the capacity of the compressor by varying the suction quantity of a gas to be compressed. According to this known vane compressor, arcuate slots are formed in a peripheral wall of the cylinder and each extends from a lateral side of a refrigerant inlet port formed through the same peripheral wall of the cylinder and also through an end plate of the cylinder, and in which is slidably fitted a throttle plate, wherein the effective circumferential length of the opening of the refrigerant inlet port is varied by displacing the throttle plate relative to the slot so that the compression commencing position in a compression chamber defined in the cylinder and accordingly the compression stroke period varies to thereby vary the capacity or delivery quantity of the compressor. A link member is coupled at one end to the throttle plate via a support shaft secured to the end plate, and at the other end to an actuator so that the link member is pivotally displaced by the actuator to displace the throttle plate.

However, according to the conventional vane compressor, because of the intervention of the link member between driving means or the actuator and a control member or the throttle plate for causing displacement of the throttle plate, the throttle plate undergoes a large hysteresis, leading to low reliability in controlling the compressor capacity, and also the capacity control mechanism using the link member, etc. requires complicated machining and assemblage.

Further, a variable capacity vane compressor which has a reduced hysteresis of the control member has been proposed by Japanese Patent Application No. 60-71984 filed by the same assignee of the present application, which provides an improvement in a vane compressor comprising a cylinder formed of a cam ring and a pair of side blocks closing opposite ends of the cam ring, a rotor rotatably received within the cylinder, a plurality of vanes radially slidably fitted in respective slits formed in the rotor, a control member disposed for displacement in a refrigerant inlet port formed in one of the side blocks, and driving means for causing the control member to be displaced relative to the refrigerant inlet port, whereby the capacity or delivery quantity of the compressor can be varied by displacement of the control member. The improvement comprises driven teeth provided on the control member, and driving teeth provided on an output shaft of the driving means in mating engagement with the driven teeth, whereby the control member is driven directly by the driving means through the mating driving and driven teeth.

However, according to this proposed vane compressor, a stepping motor as the driving means is mounted within the compressor housing, requiring a large space for accommodation of the stepping motor, and the capacity control mechanism has an overall complicated construction and accordingly is high in manufacturing cost.

SUMMARY OF THE INVENTION

It is an object of the invention to provide a variable capacity vane compressor which has a capacity control mechanism which is simple in structure and compact in size, thus facilitating assemblage and requiring a low manufacturing cost, but is capable of controlling the compressor capacity with high reliability.

According to the invention, there is provided a variable capacity vane compressor including a cylinder formed of a cam ring and a pair of front and rear side blocks closing opposite ends of the cam ring, the cylinder having at least one first inlet port formed therein, a rotor rotatably received within the cylinder, and a plurality of vanes radially slidably fitted in respective slits formed in the rotor, a housing accommodating the cylinder and defining a suction chamber therein, the housing having a rear head at a side of the rear side block remote from the rotor, a driving shaft on which the rotor is secured and extending through the front side block, and power transmitting means mounted on the driving shaft at a side of the front side block remote from the rotor, wherein compression chambers are defined between the cylinder, the rotor and adjacent ones of the vanes and varies in volume with rotation of the rotor for effecting suction of a compression medium from the suction chamber into the compression chambers through the at least one first inlet port, and compression and discharge of the compression medium.

The variable capacity vane compressor according to the invention is characterized by the improvement comprising: at least one second inlet port formed in the rear side block and adjacent a corresponding one of the first inlet port, the at least one second inlet port communicating the suction chamber with at least one of the compression chambers which is on a suction stroke; opening angle control means arranged in the rear side block for varying the opening angle of the at least one second inlet port, the opening angle control means having a pressure receiving portion defining a first pressure chamber supplied with a high pressure and a second pressure chamber supplied with a low pressure, the first and second pressure chambers being arranged in the rear side block, the pressure receiving portion being angularly displaceable in response to a difference between the high pressure in the first pressure chamber and the low pressure in the second pressure chamber for causing the opening angle control means to vary the opening angle of the at least one second inlet port; and pressure control means arranged in the rear side block and the rear head and responsive to at least one parameter representative of a thermal load on the compressor for varying at least one of the high pressure in the first pressure chamber and the low pressure in the second pressure chamber, whereby a change in the opening angle of at least one second inlet port causes a change in the timing of commencement of the compression of the compression medium.

The above and other objects, features and advantages of the invention will be more apparent from the ensuing detailed description taken in conjunction with the accompanying drawings.

DETAILED DESCRIPTION

Figure 1:
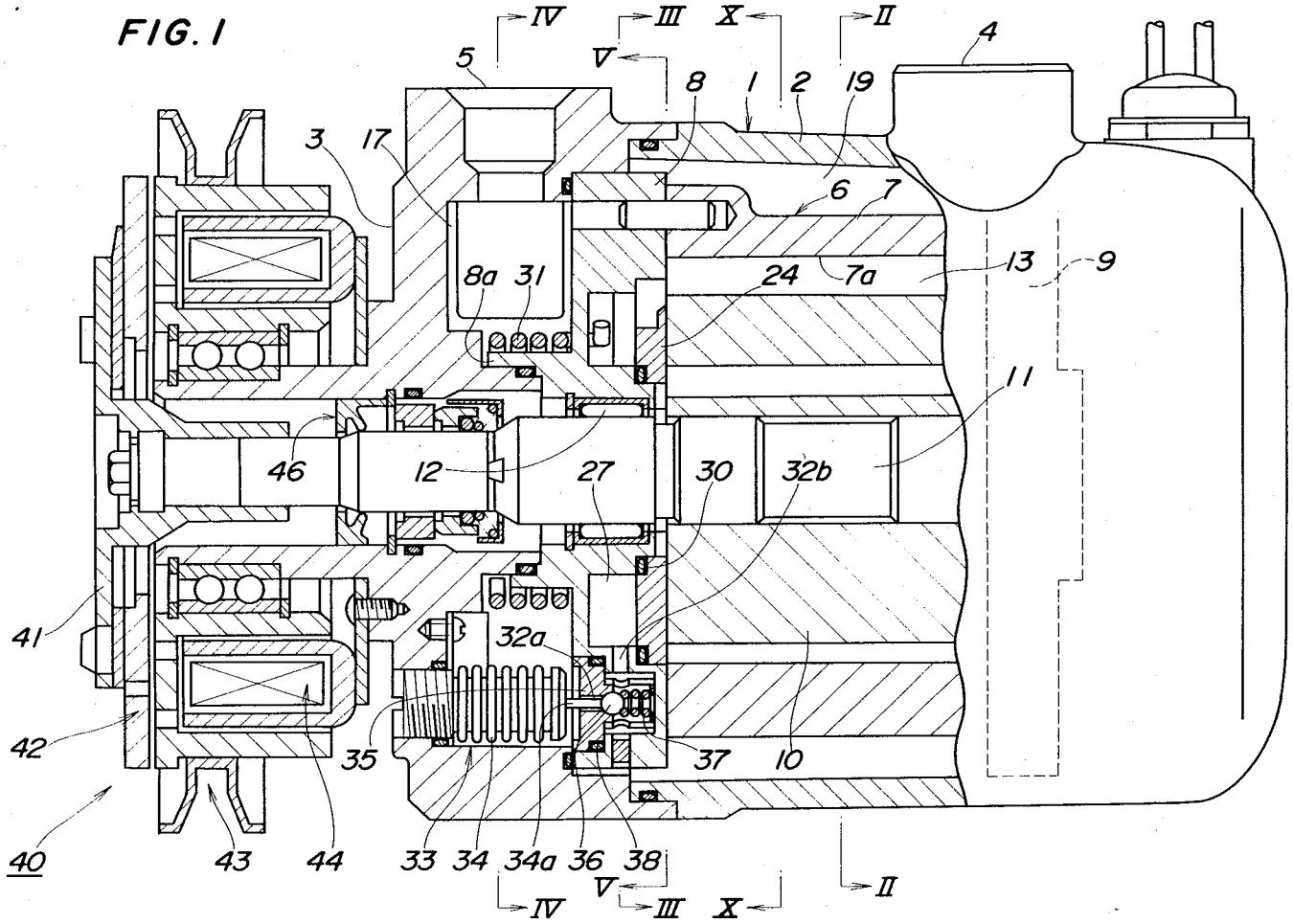
FIG. 1 is a longitudinal sectional view of a variable capacity vane compressor according to a first embodiment of the invention.

The invention will now be described in detail with reference to the drawings showing embodiments thereof.

FIGS. 1 through 12 show a variable capacity vane compressor according to a first embodiment of the invention, wherein a housing 1 comprises a cylindrical casing 2 with an open end, and a front head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a rear end thereof, and a suction port 5, through which the refrigerant gas is to be drawn into the compressor, is formed in an upper portion of the front head 3. The discharge port 4 and the suction port 5 communicate, respectively, with a discharge pressure chamber and a suction chamber, both hereinafter referred to.

A pump body 6 is housed in the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cam ring 7, and a driving shaft 11 on which is secured the rotor 10. The driving shaft 11 is rotatably supported by a pair of radial bearings 12 provided in the side blocks 8 and 9, respectively, only one of which is shown. The driving shaft 11 extends through the front side block 8 and the front head 3 while being sealed in an airtight manner against the interior of the compressor by means of a mechanical sealing device 46 provided around the shaft 11 in the front head 3.

Figure 2:
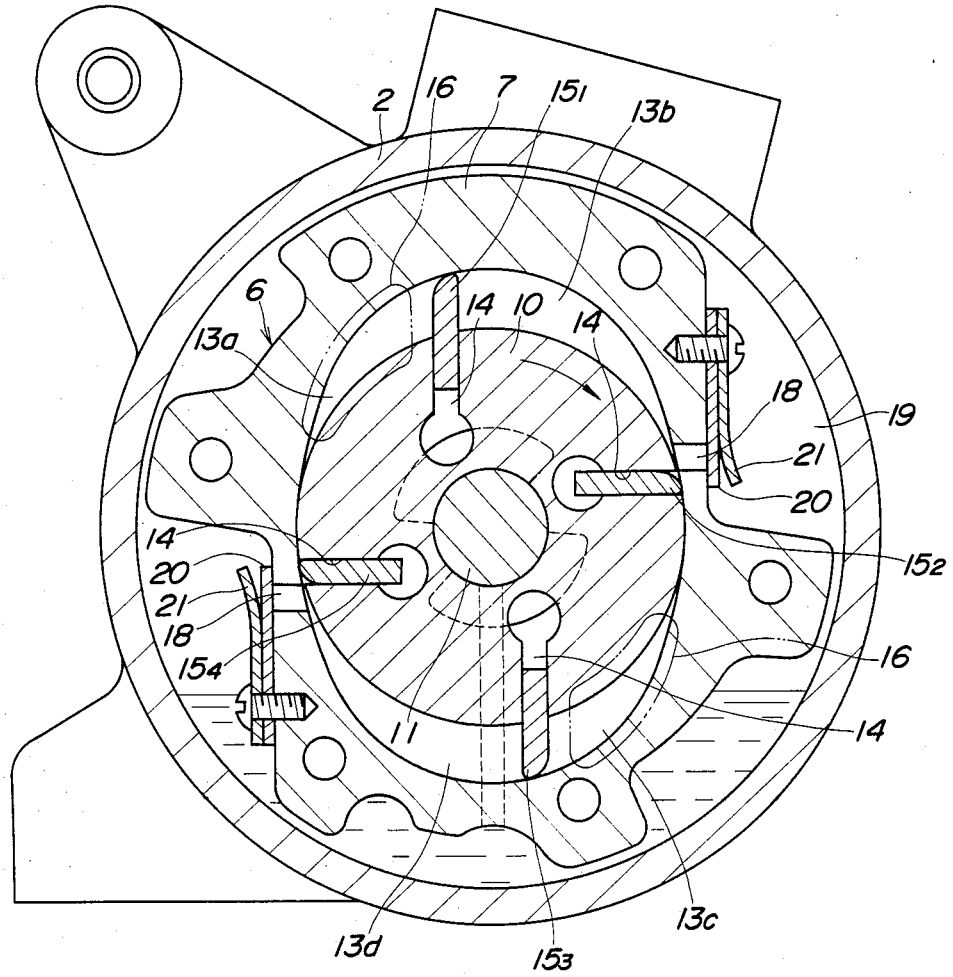
FIG. 2 is a transverse sectional view taken along line II—II in FIG. 1.

The cam ring 7 has an inner peripheral surface 7*a* with an elliptical cross section, as shown in FIG. 2, and cooperates with the rotor 10 to define therebetween a pair of spaces 13 and 13 at diametrically opposite locations.

The rotor 10 has its outer peripheral surface formed with a plurality of (four in the illustrated embodiment) axial vane slits 14 at circumferentially equal intervals, in each of which a vane $15_1$–$15_4$ is radially slidably fitted. Adjacent vanes $15_1$–$15_4$ define therebetween four compression chambers 13*a*–13*d* in cooperation with the cam ring 7, the rotor 10, and the opposite inner end faces of the front and rear side blocks 8, 9. The axial vane slits 14 open in opposite end faces of the rotor 10.

Refrigerant inlet ports 16 and 16 are formed in the front side block 8 at diametrically opposite locations as shown in FIGS. 2 through 7. These refrigerant inlet ports 16, 16 are located at such locations that they become closed when the respective compression chambers 13*a*–13*d* assume the maximum volume. These refrigerant inlet ports 16, 16 axially extend through the front side block 8 and through which a suction chamber (lower pressure chamber) 17 defined in the front head 3 by the front side block 8 and spaces 13 or compression chambers 13*a* and 13*c* on the suction stroke are communicated with each other.

Refrigerant outlet ports 18, 18 are formed through opposite lateral side walls of the cam ring 7 and through which spaces 13 or compression chambers 13*b* and 13*d* on the discharge stroke are communicated with the discharge pressure chamber (higher pressure chamber) 19 defined within the casing 2. These refrigerant outlet ports 18, 18 are provided with respective discharge valves 20 and valve retainers 21, as shown in FIG. 2.

Figure 5:
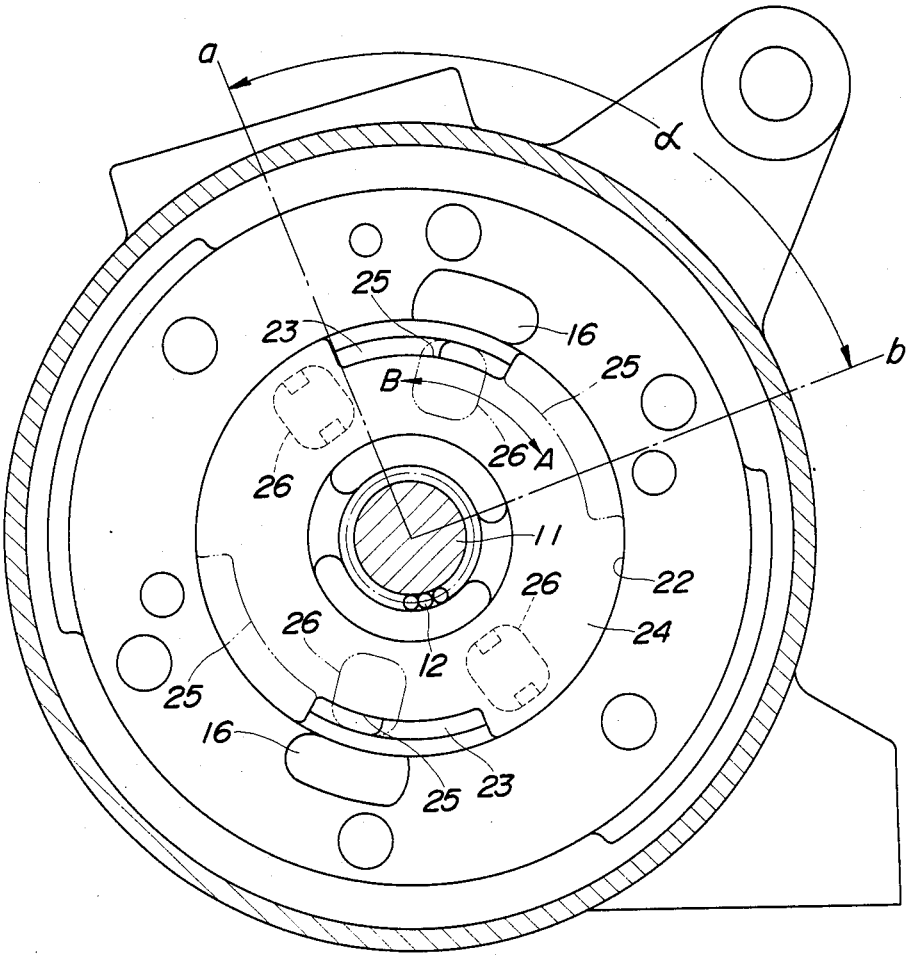
FIG. 5 is a transverse sectional view taken along line V—V in FIG. 1.
Figure 7:
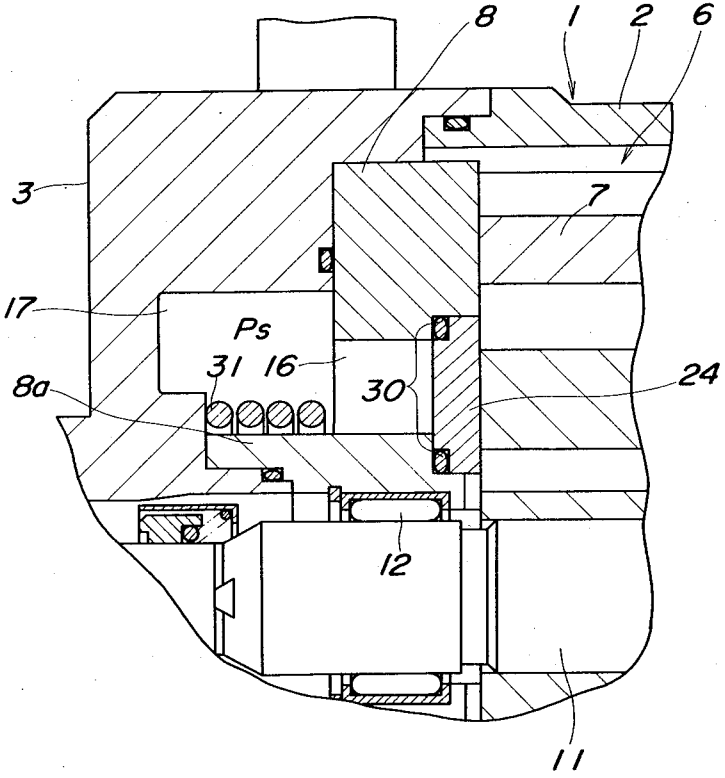
FIG. 7 is a view similar to FIG. 6, showing the vane compressor at full capacity operation.
Figure 6:
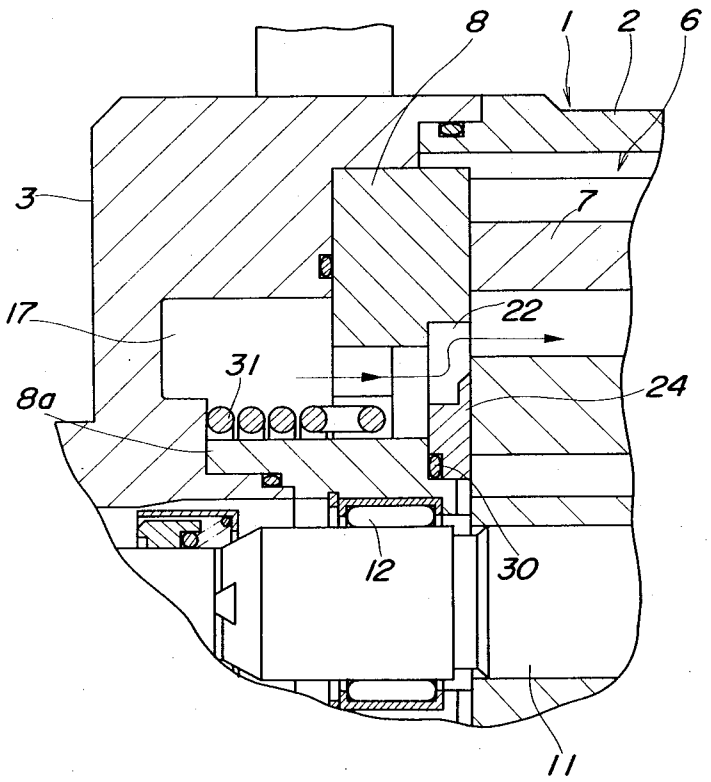
FIG. 6 is a fragmentary longitudinal sectional view taken along line VI—VI in FIG. 4, showing the vane compressor at partial capacity operation.
Figure 8:
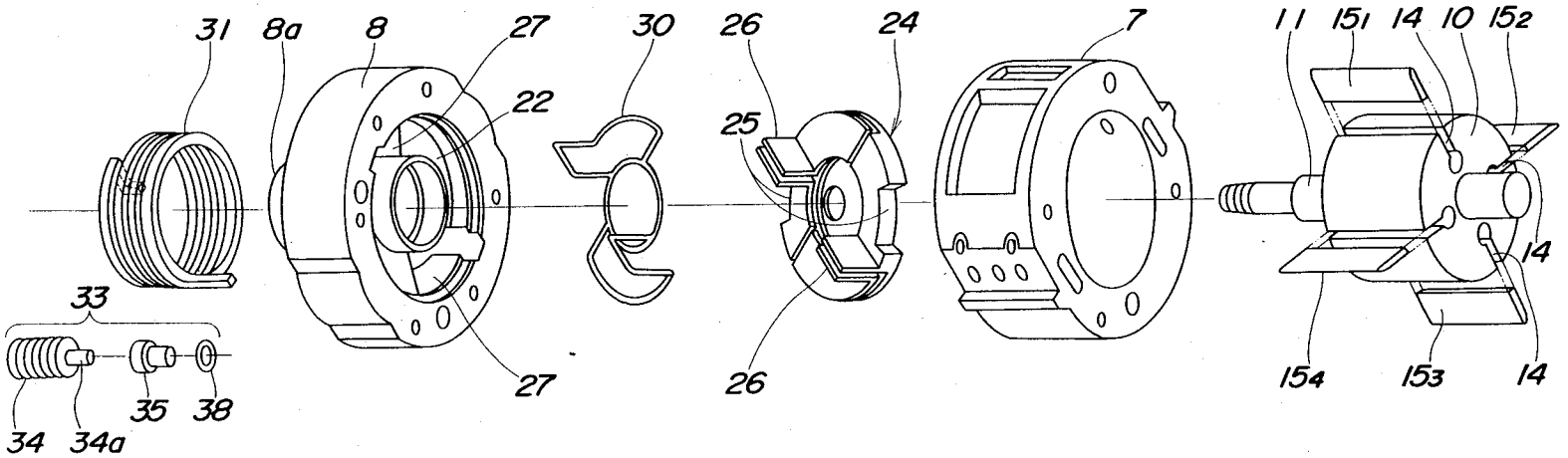
FIG. 8 is an exploded perspective view showing essential parts of the vane compressor of FIG. 1.
Figure 10:
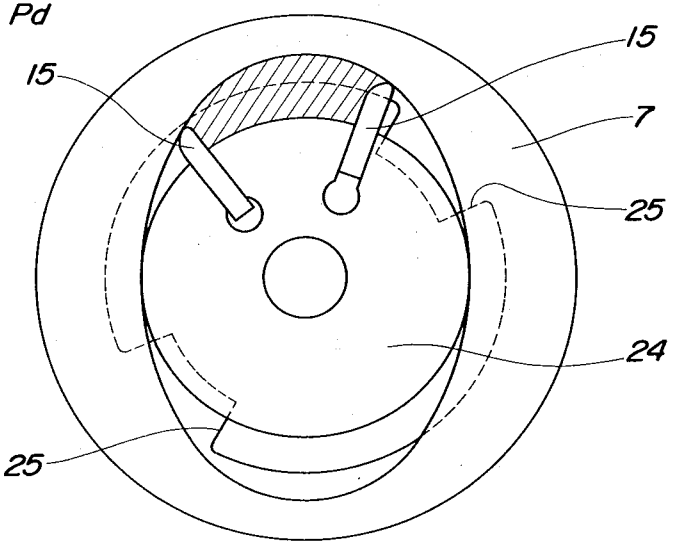
FIG. 10 is a sectional view taken along line X—X in FIG. 1, showing the circumferential position of a control element 24 at full capacity operation of the vane compressor.

The front side block 8 has an end face facing the rotor 10, in which is formed an annular recess 22 larger in diameter than the rotor 10, as shown in FIGS. 5 and 8. Due to the presence of the annular recess 22, no part of the end face of the rotor 10 facing the front side block 8 is in contact with the opposed end face of the latter. A pair of second inlet ports 23 and 23 in the form of arcuate openings are formed in the front side block 8 at diametrically opposite locations and circumferentially extend continuously with the annular recess 22 along its outer periphery, as best shown in FIG. 5, and through which the suction chamber 17 is communicated with the compression chambers 13*a*, 13*c* on the suction stroke. These second inlet ports 23, 23 open into the compression chambers 13*a*, 13*c* at circumferential positions in advance of the locations of the respective refrigerant inlet ports 16, 16 in the direction in which the vanes $15_1$–$15_4$ rotate. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite partition plates 26 and 26 axially projected therefrom and acting as pressure-receiving elements. The partition plates 26, 26 are slidably received in respective arcuate spaces 27 and 27 which are formed in the front side block 8 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated partion plate 26. The first pressure chamber $27_1$ communicates with the suction chamber 17 through the corresponding inlet port 16 and the corresponding second inlet port 23, and the second pressure chamber $27_2$ communicates with the discharge pressure chamber 19 through a restriction passage 28 formed in the front side block 8. The two chambers $27_1$, $27_2$ are communicated with each other by way of a communication passage 29 formed in the control element 24.

A sealing member 30 of a special configuration as shown in FIG. 8 is mounted in the control element 24 and disposed along an end face of its central portion and radially opposite end faces of each pressure-receiving protuberance 26, to seal in an airtight manner between the first and second pressure chambers $27_1$ and $27_2$, as well as between the end face of the central portion of the control element 24 and the inner peripheral edge of the annular recess 22 of the front side block 8, as shown in FIG. 1.

The control element 24 is elastically urged in such a circumferential direction as to increase the opening angle of the second inlet ports 23, i.e. in the counterclockwise direction as viewed in FIG. 5, by a coiled spring 31 fitted around a central boss **8*a* of the front side block 8 axially extending toward the suction chamber 17, with its one end engaged by the central boss 8 and the other end by the control element 24**, respectively.

Figure 3:
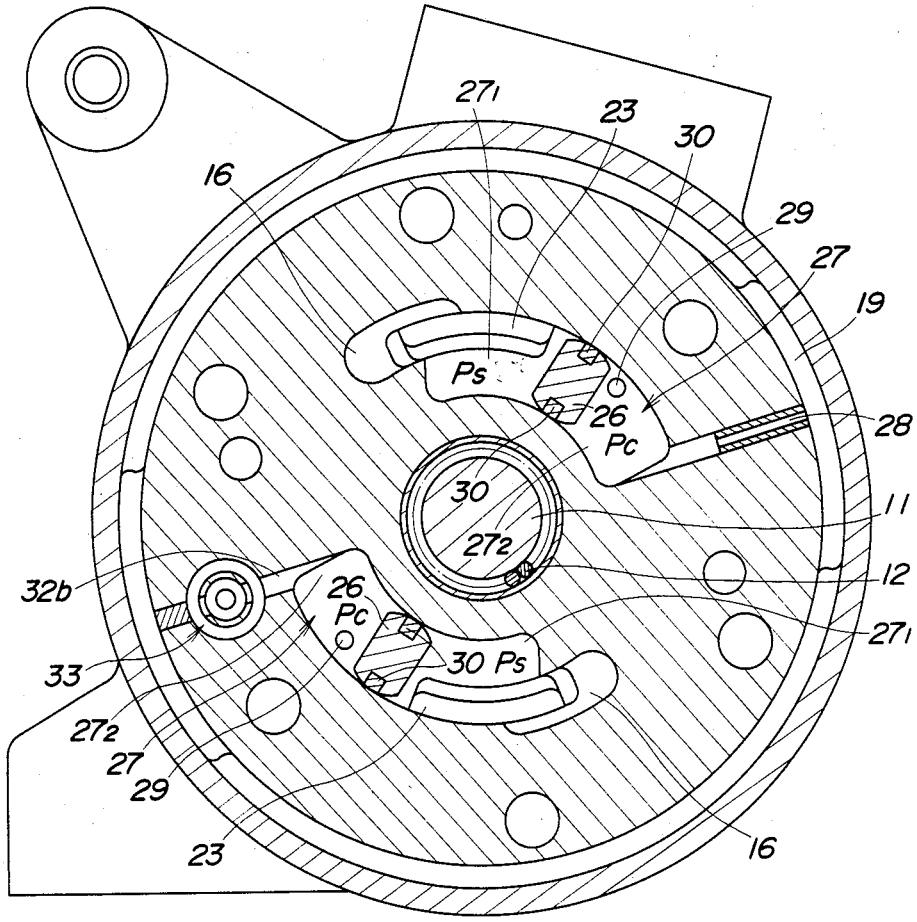
FIG. 3 is a transverse sectional view taken along line III—III in FIG. 1.
Figure 4:
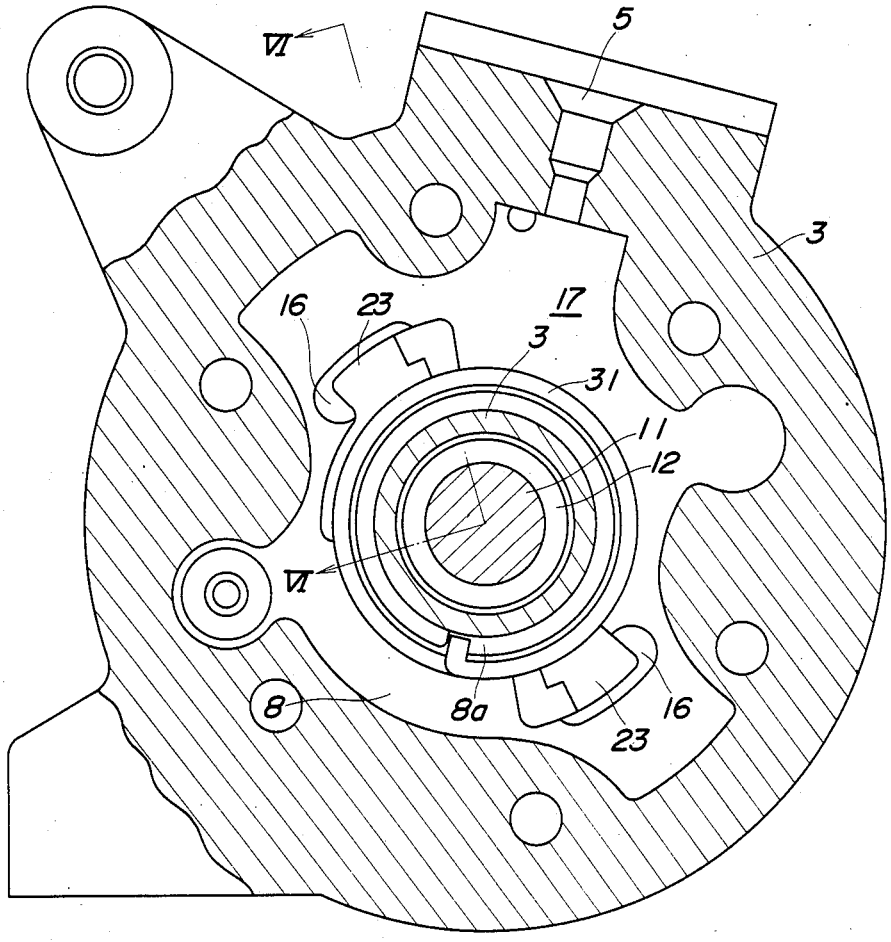
FIG. 4 is a transverse sectional view taken along line IV—IV in FIG. 1.

The second pressure chamber $27_2$ is communicated with the suction chamber 17 by way of communication passages **32*a* and 32*b* formed in the front side block 8, as shown in FIGS. 1 and 3. Arranged across these communication passages 32*a*, 32*b* is a control valve device 33 for selectively closing and opening them, as shown e.g. in FIG. 1. The control valve device 33 is operable in response to pressure within the suction chamber 17, and as shown in FIGS. 1 and 8 it comprises a flexible bellows 34 disposed in the suction chamber 17, a valve casing 35 disposed in a recess 17*a* continuous with the suction chamber 17, a ball valve 36, and a coiled spring 37 urging the ball valve 36 in its closing direction. When the suction pressure within the suction chamber 17 is above a predetermined value, the bellows 34 is in a contracted state so that the ball valve 36 is biased to close the communication passage 32 by the force of the spring 37. When the suction pressure is below the predetermined value, the bellows 34 is in an expanded state to urgingly bias the ball valve 36 through its tip rod 34*a* to open the communication passage 32 against the force of the spring 37. An O-ring 38 is interposed between the valve casing 35 and the recess 17*a* in the front side block 8**.

On the other hand, a magnet clutch 40 as power transmitting means is mounted on a front end of the driving shaft 11 by means of a hub 41, which comprises an armature plate 42 secured on the front end of the driving shaft 11, a pulley 43 rotatably supported by a boss of the front head 3 via a radial ball bearing, and a clutch coil 44 fixed to a front end face of the front head 3.

The operation of the first embodiment of the invention will now be explained.

As the pulley 43 of the magnet clutch 40 is rotatively driven by a prime mover such as an automotive engine to cause clockwise rotation of the rotor 10 as viewed in FIG. 2 through the magnet clutch 40, the rotor 10 rotates so that the vanes $15_1$–$15_4$ successively move radially out of the respective slits 14 due to a centrifugal force and back pressure acting upon the vanes and revolve together with the rotating rotor 10, with their tips in sliding contact with the inner peripheral surface **7*a* of the cam ring 7. During the suction stroke each compression chamber 13*a*, 13*c* defined by adjacent vanes increases in volume so that refrigerant gas as thermal medium is drawn through the refrigerant inlet port 16 into the compression chamber 13*a*, 13*c*; during the following compression stroke the compression chamber 13*b*, 13*d* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4** into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the restriction passage 28 or through both the restriction passage 28 and the communication passage 29. The control element 24 is circumferentially displaced depending upon the difference between the sum S of the pressure Ps within the first pressure chamber $27_1$ and the biasing force of the coiled spring 31 (which acts upon the control element 24 in the direction of the opening angle of each second inlet port 23 being increased as indicated by the arrow B in FIG. 5) and the pressure Pc within the second pressure chamber $27_2$ (which acts upon the control element 24 in the direction of the above opening angle being decreased as indicated by the arrow A in FIG. 5), to vary the opening angle of each second inlet port 23 and accordingly vary the timing of commencement of the compression stroke and hence the delivery quantity. When the above difference becomes zero, that is, when the sum S of the pressure Ps within the first pressure chamber $27_1$ and the biasing force of the spring 31 becomes balanced with the pressure Pc within the second pressure chamber $27_2$, the circumferential displacement of the control element 24 stops.

Figure 9:
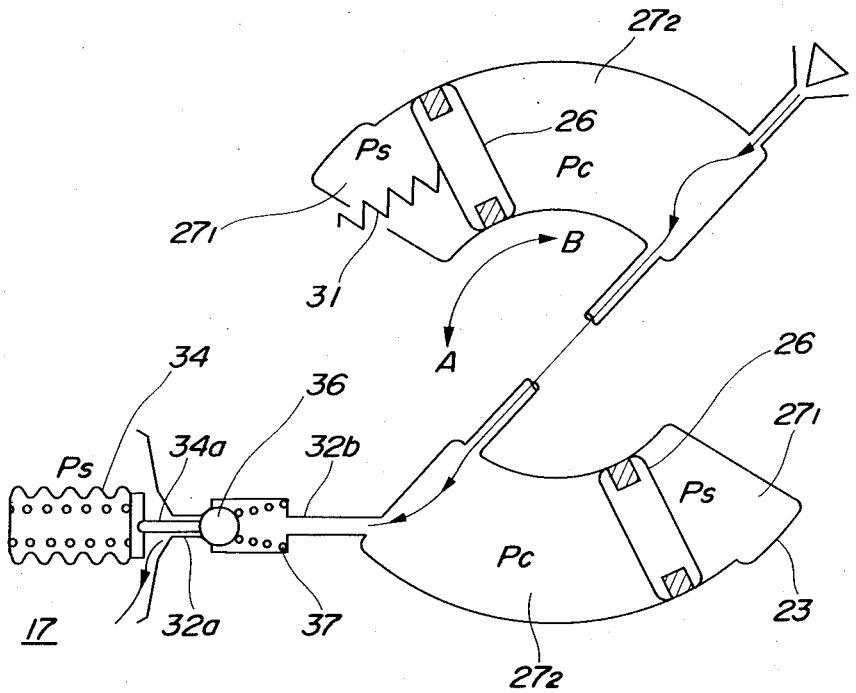
FIG. 9 is a diagrammatic view useful in explaining the balance in pressure between first and second pressure chambers $27_1$, $27_2$ at full capacity operation of the vane compressor.

For instance, when the compressor is operating at low speeds, the refrigerant gas pressure or suction pressure Ps within the suction chamber 17 is so high that the bellows 34 of the control valve device 33 is contracted to bias the ball valve 36 to block the communication passage **32*a*, as shown in FIG. 9. Accordingly, the pressure Pc within the second pressure Pc chamber $27_2$ surpasses the sum of the pressure Ps within the first pressure chamber $27_1$ and the biasing force of the coiled spring 31 (acting in the direction indicated by the arrow B in FIG. 5) so that the control element 24 is circumferentially displaced into an extreme position in the direction indicated by the arrow A in FIG. 9, whereby the second inlet ports 23, 23 are fully closed by the control element 24 as indicated by the two-dot chain lines in FIG. 10 (the opening angle is zero). Consequently, all the refrigerant gas drawn through the refrigerant inlet port 16 into the compression chamber 13***a*, 13*c* on the suction stroke is compressed and discharged, resulting in the maximum delivery quantity (Full Capacity Operation), as indicated by the hatched portion in FIG. 10.

Figure 12:
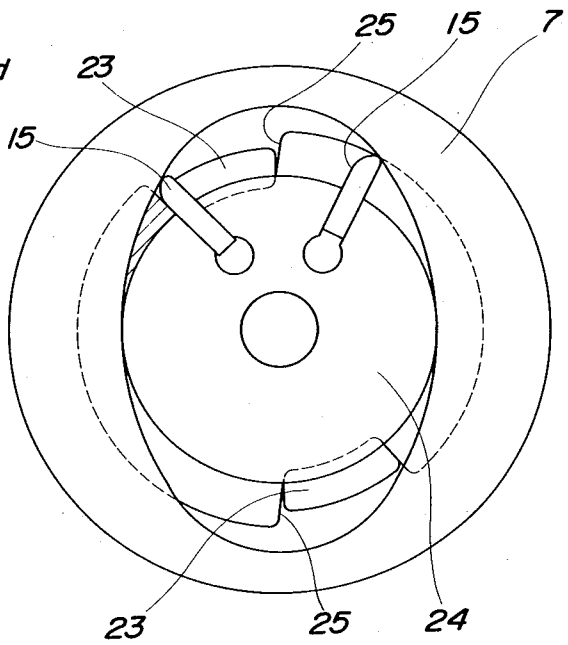
FIG. 12 is a view similar to FIG. 10, at partial capacity operation of the vane compressor.
Figure 11:
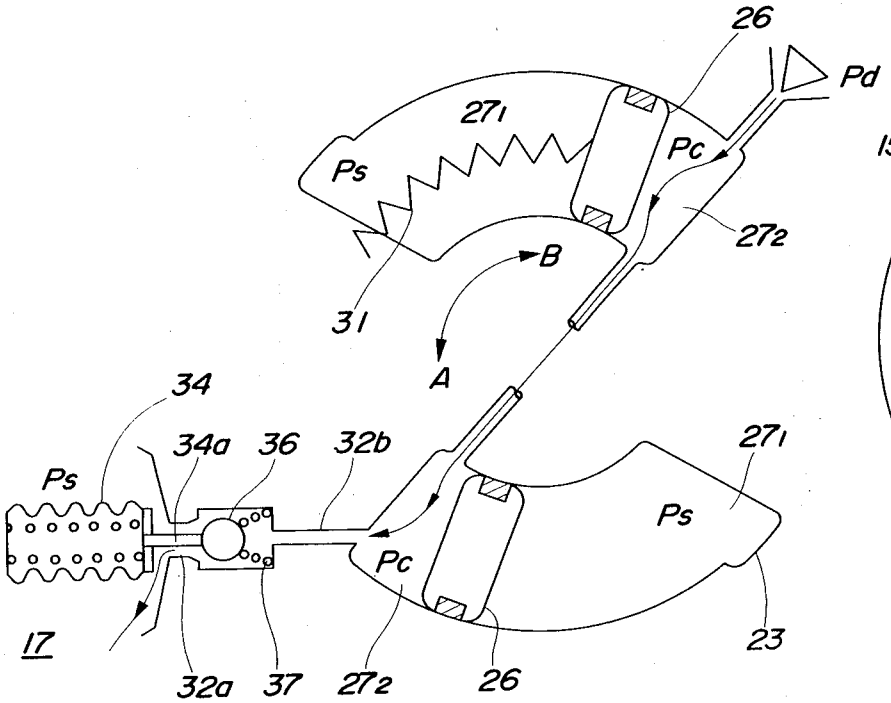
FIG. 11 is a view similar to FIG. 9, at partial capacity operation of the vane compressor.
Figure 13:
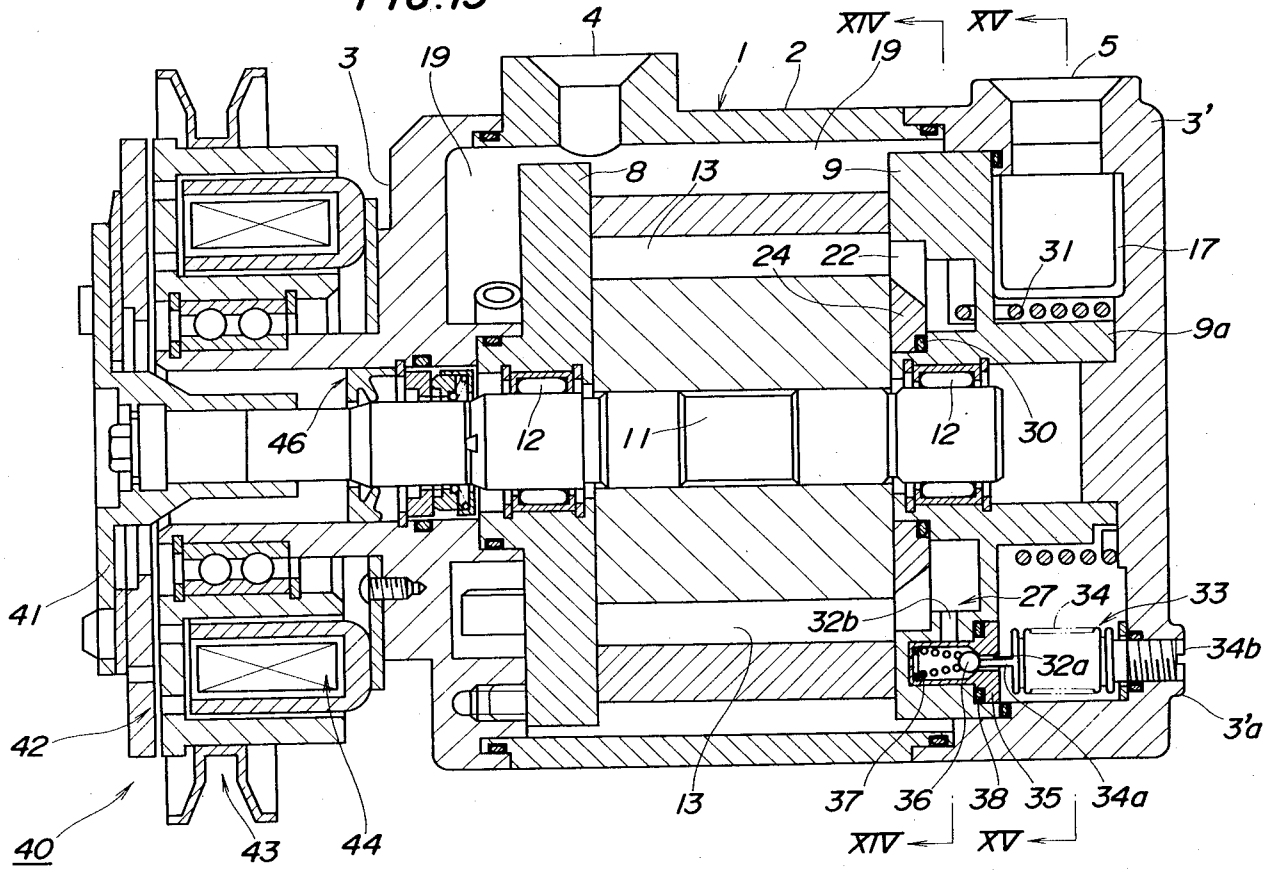
FIG. 13 is a view similar to FIG. 1, showing a second embodiment of the invention.

On the other hand, when the compressor is operating at high speeds, the suction pressure Ps within the suction chamber 17 is so low that the bellows 34 of the control valve 33 is expanded to urgingly bias the ball valve 36 through its rod 34*a* to open the communication passage 32*a* against the force of the spring 37 to a degree corresponding to the suction pressure, as shown in FIG. 11. Accordingly, the pressure Pc within the second pressure chamber $27_2$ leaks through the communication passageway 32*a*, 32*b* into the suction chamber 17 in which low or suction pressure prevails to cause a drop in the pressure Pc within the second pressure chamber $27_2$. As a result, the control element 24 is angularly or circumferentially displaced in the direction indicated by the arrow B in FIG. 11. When the cut-out portions 25, 25 of the control element 24 become aligned with the respective second inlet ports 23, 23 to open the latter, as shown in FIGS. 5 and 12, refrigerant gas in the suction chamber 17 is drawn into the compression chambers 13*a*, 13*c* not only the refrigerant inlet ports 16, 16 but also through the second inlet ports 23, 23. Therefore, the timing of commencement of the compression stroke is retarded so that the compression stroke period is reduced, resulting in a reduced amount of refrigerant gas that is compressed and hence a reduced delivery quantity (Partial Capacity Operation), as indicated by the hatched portion in FIG. 12.

As noted before, the opening angle of the second inlet ports 23, 23 is controlled to a value where the sum S of the pressure force Ps within the first pressure chamber $27_1$ and the force of the coiled spring 31 balances with the pressure force Pc within the second pressure chamber $27_2$. The circumferential position of the control element 24 varies in a continuous manner in response to change in the suction pressure within the suction chamber 17. Thus, the delivery quantity or capacity of the compressor is controlled to vary in a continuous manner.

FIGS. 13 through 18 show a second embodiment of the invention. The second embodiment is distinguished from the first embodiment described above in that the suction port and the capacity control mechanism are arranged on the rear side of the compressor.

In FIGS. 13 through 18, corresponding or similar elements or parts to those in FIGS. 1 through 12 are designated by identical reference numerals, and detailed description thereof is omitted.

In the vane compressor according to the second embodiment, a housing 1 comprises a cylindrical casing 2 with an open end, and a rear head 3' secured to the casing 2 in a manner closing the open end of the latter, by means of bolts, not shown. A discharge port 4 through which compressed refrigerant gas as thermal medium is discharged from the compressor is provided in an upper wall of the casing 2 at a front end thereof, and a suction port 5 through which suction refrigerant gas is drawn into the compressor is provided in an upper portion of the rear head 3'. A discharge pressure chamber 19 is defined between the casing 2, the cam ring 7, and the front and rear side blocks 8, 9, and also between the front head 3 and the front side block 8.

Figure 14:
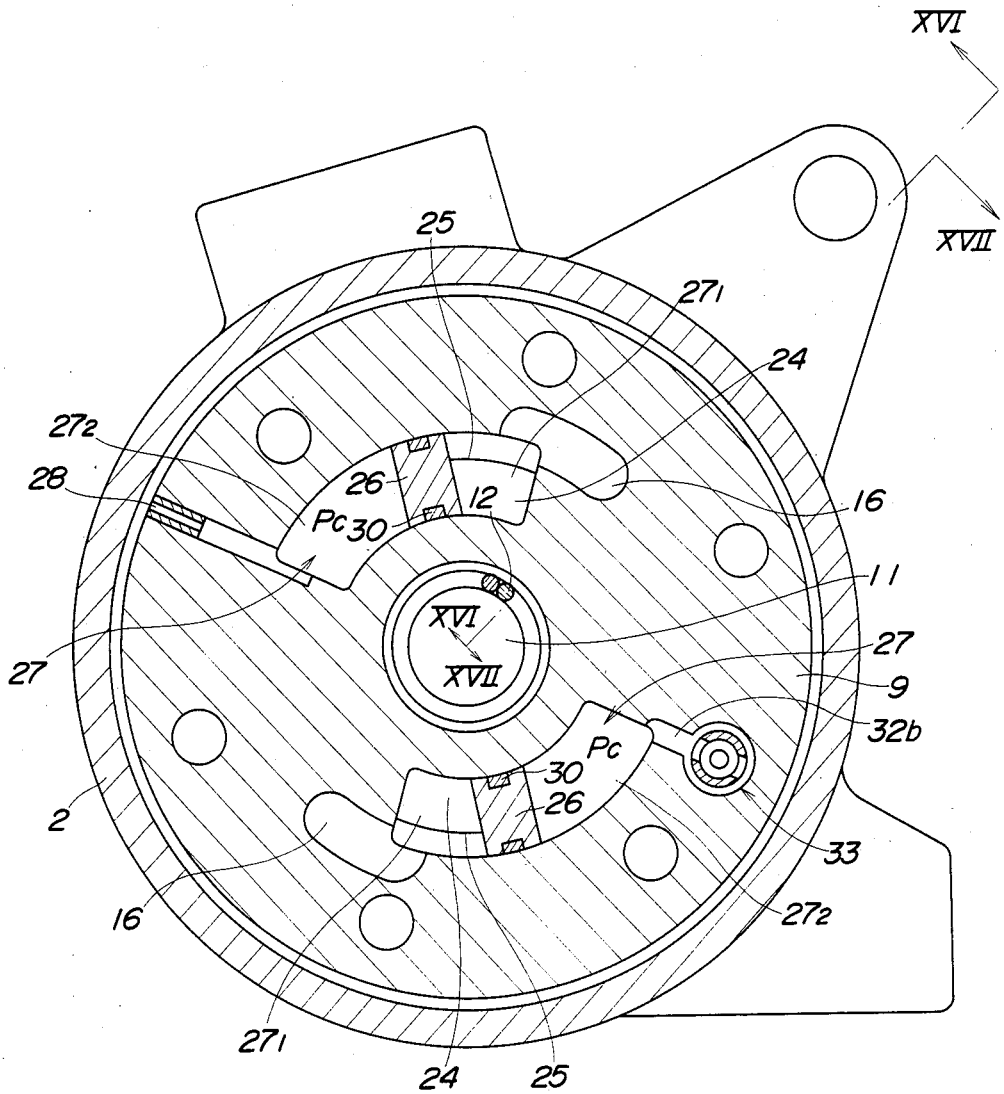
FIG. 14 is a transverse sectional view taken along line XIV—XIV in FIG. 13.
Figure 15:
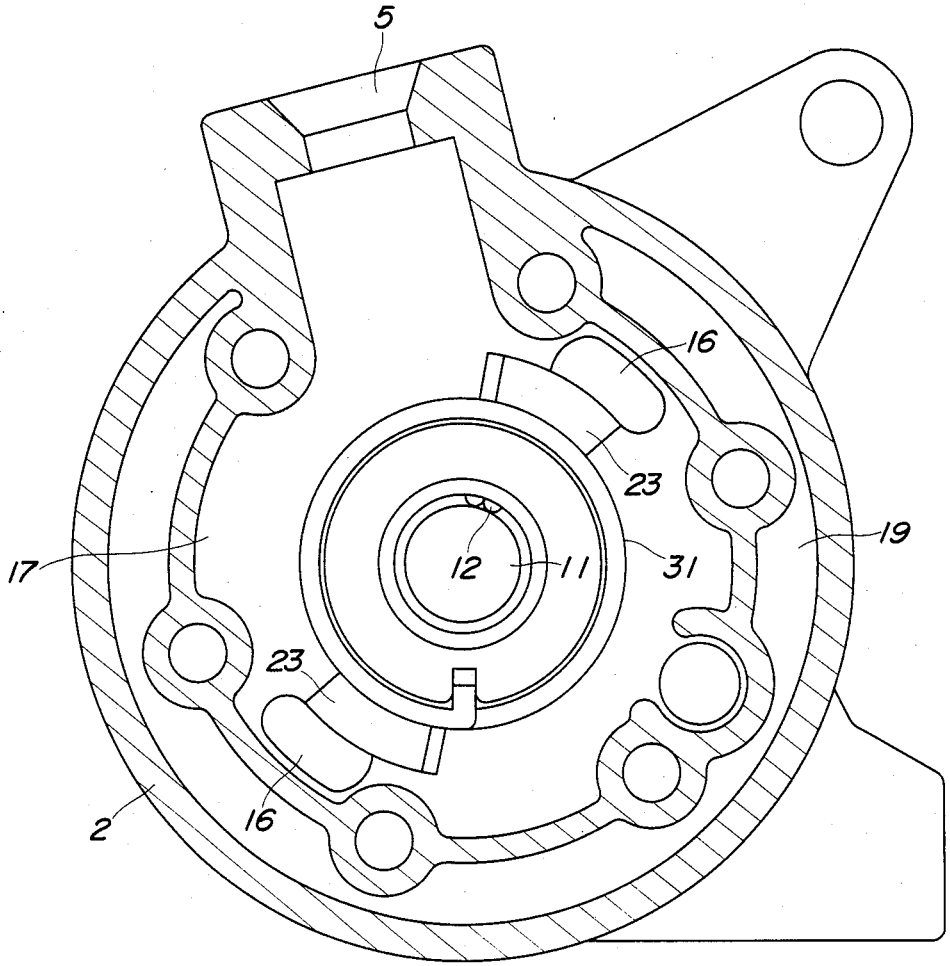
FIG. 15 is a transverse sectional view taken along line XV—XV in FIG. 13.
Figure 16:
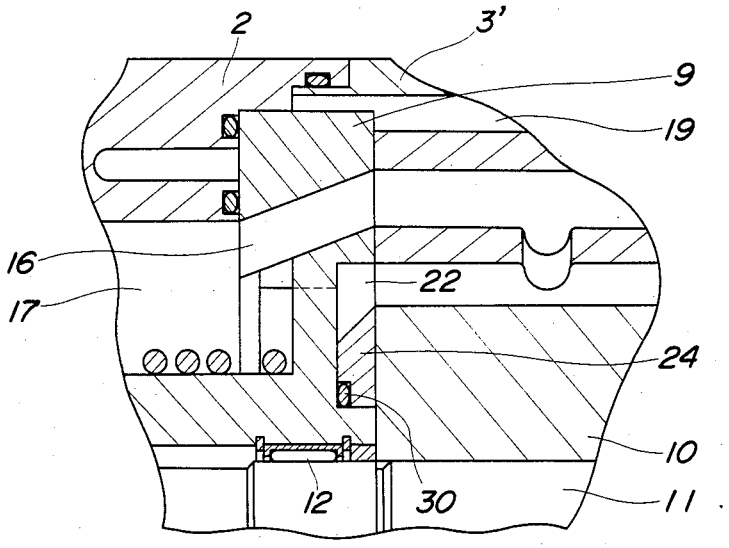
FIG. 16 is a fragmentary longitudinal sectional view taken along line XVI—XVI in FIG. 14.
Figure 17:
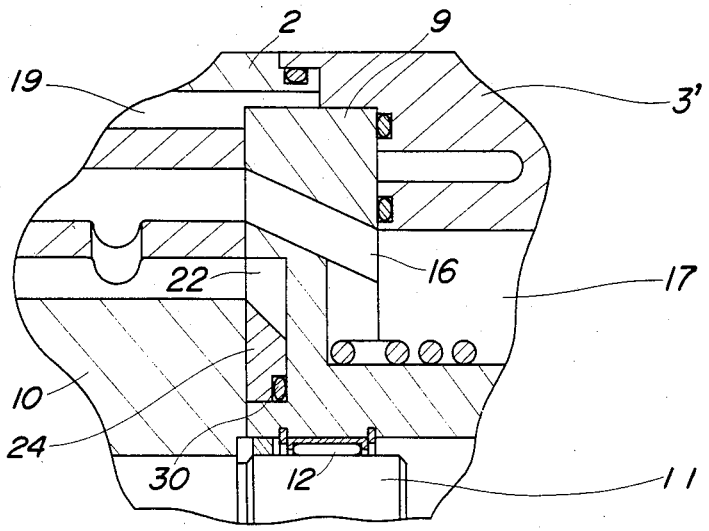
FIG. 17 is a fragmentary longitudinal sectional view taken along line XVII—XVII in FIG. 14.
Figure 18:
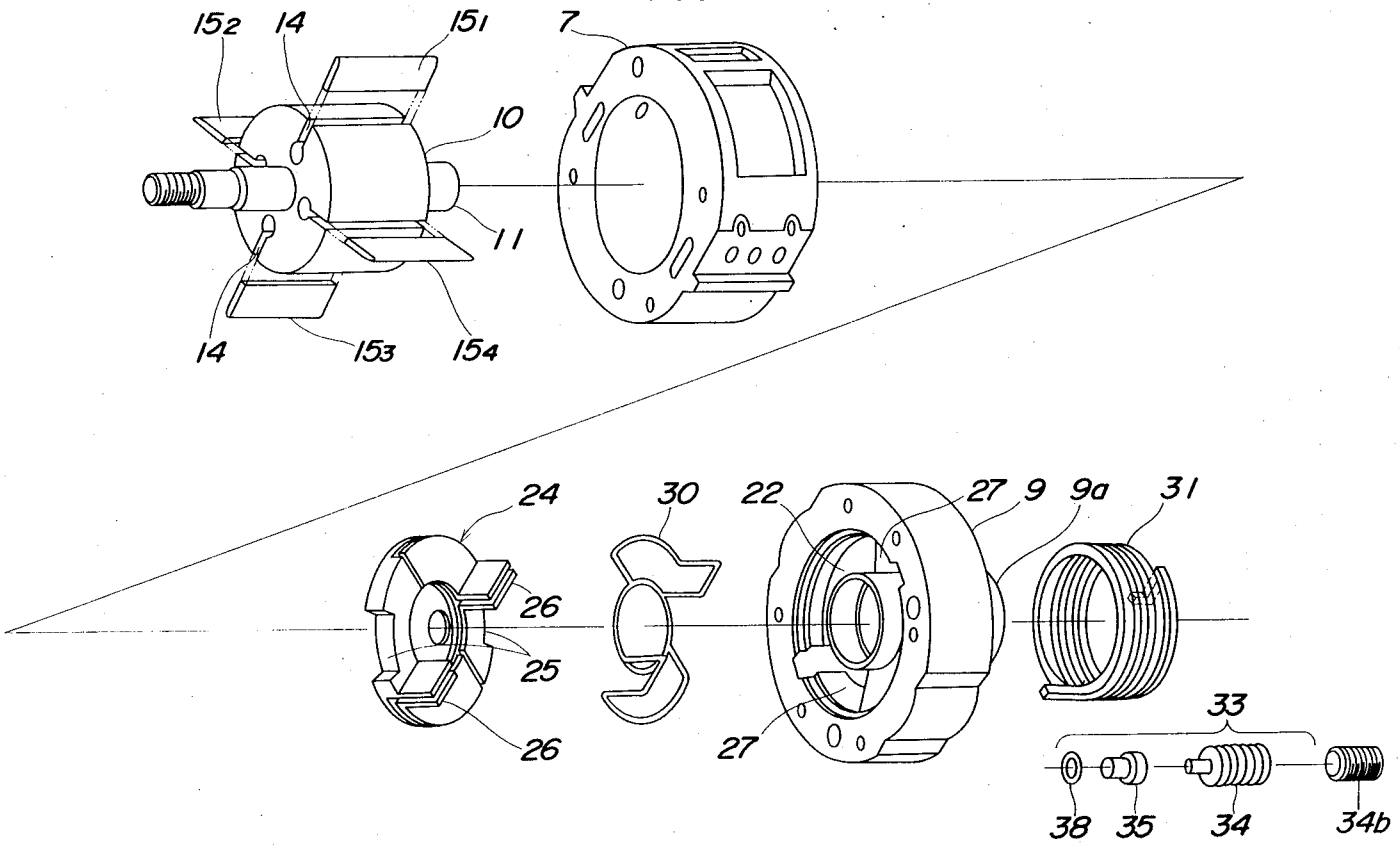
FIG. 18 is an exploded perspective view showing essential parts of the vane compressor of FIG. 13.

Refrigerant inlet ports 16 and 16 are formed in the rear side block 9 at diametrically opposite locations as shown in FIGS. 14 and 15. The refrigerant inlet ports 16, 16 axially extend through the rear side block 9 and through which a suction chamber (lower pressure chamber) 17 defined in the rear head 3' by the rear side block 9 and respective compression chambers 13 on the suction stroke are communicated with each other.

As seen in FIG. 5, the opening angle of each second inlet port 23 is an angle $\alpha$, shown with respect to the axis of the rotor 10, between a downstream end a of each cut-out 25 in the direction of rotation of the rotor 10 and a given circumferential point b upstream of the downstream end a.

The rear side block 9 has an end face facing the rotor 10, in which is formed an annular recess 22. A pair of second inlet ports 23 and 23 are formed in the rear side block 9, and an annular control element 24 is received in the annular recess 22 for rotation in opposite circumferential directions to control the opening angle of the second inlet ports 23, 23, in a similar manner to the first embodiment. The second inlet ports 23, 23 and the control element 24 are substantially identical in configuration and arrangement with those in the first embodiment. The rear side block 9 has arcuate spaces 27, 27 formed therein in which partition plates 26, 26 integral with the control element are received to divide same into first and second pressure chambers $27_1$ and $27_2$, in a similar manner to the first embodiment. A coiled spring 31, which elastically urges the control element 24 in such a circumferential direction as to increase the opening angle of the second inlet ports 23, is fitted around a central boss 9*a* of the rear side block 9 axially extending and around which is defined the annular suction chamber 17, with its one end engaged by the central boss 9 and the other end by the control element 24, respectively.

Communication passages 32*a*, 32*b* which communicate the second pressure chamber $27_2$ with the suction chamber 17, are formed in the rear side block 9. Also arranged in the rear side block 9 is a control valve device 33 for selectively closing and opening the communication passageway 32*a*, 32*b* of which flexible bellows 34 is disposed in the suction chamber 17. The bellows 34 has its degree of elasticity adjustable by means of a screw 34*b* rotatably fitted in a tapped bore 3'*a* formed through a rear end wall of the rear head 3'. The valve casing 35, the ball valve 36, and the spring 37 are constructed and arranged in the rear side block 9 in a similar manner to the first embodiment.

The other elements and parts, not referred to above, are constructed and arranged in similar manners to those in the first embodiment.

The operation of the second embodiment is substantially identical with the first embodiment, including the operation of the capacity control mechanism, and description of which is omitted.

The second embodiment of the invention in which the capacity control mechanism comprising the control element 24, the control valve device 33, and the coiled spring 31 are at the rear side of the compressor has the following advantages over the first embodiment in which these component parts are arranged at the front side of the compressor:

(i) Freedom of design of the compressor is large. For example, since the magnetic clutch 40 is not arranged at the rear side of the compressor, the arrangement of the second embodiment facilitates the operation of adjusting the bellows 34 to set the valve predetermined pressure (suction pressure) to the predetermined value, e.g.

2 kg/cm$^2$, below which the control valve device 33 opens, because the adjusting operation, if carried out by actually operating the tentatively assembled compressor, is not hindered by the presence of the magnet clutch 40. Secondly, unlike the front side of the compress-or at which the magnet clutch 40, the mechanical sealing device 46, etc. are provided and accordingly a limited space exists between the front side block 8 and these component parts, the rear side arrangement enables arranging the coiled spring 31 there, with more freedom, as well as selecting the size of the spring over a wider range.

(ii) The provision of the capacity control mechanism at the rear side does not necessitate employing a longer driving shaft 11, that is, it permits use of a conventional driving shaft having an ordinary length, thus being free of requirements that the driving shaft has to be increased in diameter so as to have sufficient mechanical strength and prevent resonance during operation of the compressor, as distinct from the front side arrangement which requires use of a longer driving shaft due to the presence of the capacity control mechanism between the front side block 8 and the magnet clutch 40.

(iii) Since the provision of the capacity control mechanism at the rear side thus permits use of more conventional component parts so far used in the front side in particular, including the driving shaft 11, it is advantageous in enabling employment of more common component parts in both variable capacity vane compressors and fixed capacity vane compressors, thus curtailing the manufacturing costs.

In the first and second embodiments described above, instead of sensing the change of the suction pressure by means of the bellows 34 of the control valve device 33 a change may be sensed in a signal representing a thermal load such as the discharge air temperature of the evaporator, passenger compartment temperature, atmospheric temperature, and solar radiation, and in response to such signal change an electromagnetic valve may be operated to interrupt or establish the communication passageway 32*a*, 32*b*.

Further, although in the foregoing embodiments the second pressure chamber $27_2$ is supplied with discharge gas pressure from the discharge pressure chamber 19, back pressure acting upon the vanes 151 154 $15_4$ to urge them in the radially outward direction may be supplied to the second pressure chamber $27_2$, instead of the discharge gas pressure.

What is claimed is:

1. In a variable capacity vane compressor including: a clutch;

a cylinder formed of a cam ring and a pair of a front side block arranged close to said clutch and a rear side block arranged remote from said clutch, said front and rear side blocks closing opposite ends of said cam ring, said cylinder having at least one first inlet port formed therein, a rotor rotatably received within said cylinder, and a plurality of vanes radially slidably fitted in respective slits formed in said rotor; and a housing defining a suction chamber therein, said housing having a rear head at a side of said rear side block remote from said rotor, a driving shaft on which said clutch and said rotor are secured, said driving shaft extending through said front side block, and power transmitting means mounted on said driving shaft at a side of said front side block remote from said rotor; and wherein compression chambers are defined between said cylinder, said rotor and adjacent ones of said vanes and said compression chambers varying in volume with rotation of said rotor for effecting suction of a compression medium from said suction chamber into said compression chambers through said at least one first inlet port, and compression and discharge of said compression medium;

the improvement comprising:

at least one second inlet port formed in said rear side block and adjacent a corresponding first inlet port, said at least one second inlet port extending circumferentially and communicating said suction chamber with at least one of said compression chambers which is on a suction stroke;

an annular opening angle control element arranged in said rear side block at an end face of said rear side block facing said rotor and coaxially with said driving shaft for rotation about an axis of said driving shaft, said annular opening angle control element being so disposed that a circumferential position thereof determines the opening angle of said at least one second inlet port, said annular opening angle control element having a radially extending pressure receiving portion integrally formed on an end face thereof remote from said rotor and defining a first pressure chamber communicating with a high pressure side to be supplied with discharge pressure therefrom and a second pressure chamber communicating with said suction chamber to be supplied with a suction pressure from said suction chamber, said first and second pressure chambers being arranged in said rear side block circumferentially of said control element, said pressure receiving portion being angularly displaceable in response to a difference between pressure in said first pressure chamber and pressure in said second pressure chamber for causing said opening angle control means to vary the opening angle of said at least one second inlet port;

biasing means for urging said annular opening angle control element in a direction in which the opening angle of said at least one second inlet port is increased; and pressure control means arranged in said rear side block and said rear head and being responsive to at least one parameter representative of a thermal load on said compressor for varying at least one of the pressure in said first pressure chamber and the pressure in said second pressure chamber, whereby a change in the opening angle f said at least one second inlet port causes a change in the timing of commencement of the compression of the compression medium;

said pressure control means comprising a valve mechanism including means for detecting said suction pressure of said compression medium in said suction chamber as said at least one parameter representative of the thermal load on said compressor, means for closing said valve mechanism to disconnect said first pressure chamber and said suction chamber from each other when the detected suction pressure is higher than a predetermined value, and means for opening said valve mechanism to allow escape of the pressure in said first pressure chamber to said suction chamber to thereby decrease said difference between the pressure in said first pressure chamber and the pressure in said second pressure chamber when the detected suction pressure is lower than said predetermined value.

2. A variable capacity vane compressor as claimed in claim 1, wherein said first pressure chamber is supplied with a discharge pressure of said compression medium discharged from said compression chambers.

3. A variable capacity vane compressor as claimed in claim 1, wherein said first pressure chamber is supplied with a back pressure acting upon radially inner end faces of each of said vanes.

4. A variable capacity vane compressor as claimed in claim 1, wherein a suction volume of a substantial inlet port defined by said at least one first inlet port and said at least one second inlet port is increased with an increase in the opening angle of said second inlet port.

5. A variable capacity vane compressor as claimed in claim 1, wherein said control valve means comprises a communication passageway provided in said rear side block and extending between said second pressure chamber and said lower pressure zone, and a valve arranged across said communication passageway for blocking said communication passageway when the suction pressure in said suction chamber is higher than said predetermined value, and opening said communication passageway when the suction pressure in said suction chamber is lower than said predetermined value.

6. A variable capacity vane compressor as claimed in claim 5, wherein said suction chamber is defined by said rear side block within said rear head, said valve comprising a bellows arranged in said suction chamber for contraction and expansion in response to the suction pressure within said suction chamber, and a valve body disposed to be closed to disconnect said first pressure chamber from said lower pressure zone when said bellows contracts, and to be opened to a degree corresponding to the suction pressure to allow communication between said first pressure chamber and said lower pressure zone when said bellows expands.

7. A variable capacity vane compressor as claimed in claim 6, including screw means exposed to an outer wall surface of said rear head remote from said rotor, for adjusting the degree of elasticity of said bellows.

8. In a variable capacity vane compressor including:

a clutch;

a cylinder formed of a cam ring and a pair of a front side block arranged close to said clutch and a rear side block arranged remote from said clutch, said front and rear side blocks closing opposite ends of said cam ring, said cylinder having at least one first inlet port formed therein, a rotor rotatably received within said cylinder, and a plurality of vanes radially slidably fitted in respective slits formed in said rotor; and a housing defining a suction chamber therein, said housing having a rear head at a side of said rear side block remote from said rotor, a driving shaft on which said clutch and said rotor are secured, said driving shaft extending through said front side block, and power transmitting means mounted on said driving shaft at a side of said front side block remote from said rotor; and wherein compression chambers are defined between said cylinder, said rotor and adjacent ones of said vanes and said compression chambers varying in volume with rotation of said rotor for effecting suction of a compression medium from said suction chamber into said compression chambers through said at least one first inlet port, and compression and discharge of said compression medium;

the improvement comprising:

at least one second inlet port formed in said rear side block and adjacent a corresponding first inlet port, said at least one second inlet port extending circumferentially and communicating said suction chamber with at least one of said compression chambers which is on a suction stroke;

an annular opening angle control element arranged in said rear side block at an end face of said rear side block facing said rotor and coaxially with said driving shaft for rotation about an axis of said driving shaft, said annular opening angle control element being so disposed that a circumferential position thereof determines the opening angle of said at least one second inlet port, said annular opening angle control element having a radially extending pressure receiving portion integrally formed on an end face thereof remote from said rotor and defining a first pressure chamber communicating with a high pressure side to be supplied with discharge pressure therefrom and a second pressure chamber communicating with said suction chamber to be supplied with a suction pressure from said suction chamber, said first and second pressure chambers being arranged in said rear side block circumferentially of said control element, said pressure receiving portion being angularly displaceable in response to a difference between pressure in said first pressure chamber and pressure in said second pressure chamber for causing said opening angle control means to vary the opening angle of said at least one second inlet port;

biasing means for urging said annular opening angle control element in a direction in which the opening angle to said at least one second inlet port is increased;

pressure control means arranged in said rear side block and said rear head and being responsive to at least one parameter representative of a thermal load on said compressor for varying at least one of the pressure in said first pressure chamber and the pressure in said second pressure chamber, whereby a change in the opening angle of said at least one second inlet port causes a change in the timing of commencement of the compression of the compression medium;

said pressure control means comprising control valve means arranged in said rear side block and said rear head, said control valve means including means for detecting a suction pressure of said compression medium in said suction chamber as said at least one parameter representative of the thermal load on said compressor, means for closing said valve means to disconnect said first pressure chamber from a zone under a lower pressure in said compressor when the detecter suction pressure is higher than a predetermined value, and means for opening said valve means to a degree corresponding to the detected suction pressure to allow escape of the high pressure in said first pressure chamber to said lower pressure zone to thereby decrease said difference between said high and low pressure when the detecter suction pressure is lower than said predetermined value;

said control valve means comprising a communication passageway provided in said rear side block and extending between said second pressure chamber and said lower pressure zone, and a valve arranged across said communication passageway for blocking said communication passageway when suction pressure in said suction chamber is higher than said predetermined value, and opening said communication passageway when the suction pressure in said suction chamber is lower than said predetermined value; and said suction chamber being defined by said rear side block within said rear head, said valve comprising a bellows arranged in said suction chamber for contraction and expansion in response to the suction pressure within said suction chamber, and a valve body disposed to be closed to disconnect said first pressure chamber from said lower pressure zone when said bellows contracts, and to be opened to a degree corresponding to the suction pressure allow comunication between said first pressure chamber and said lower pressure zone when said bellows expands.

9. A variable capacity vane compressor as claimed in claim 8, including screw means exposed to an outer wall surface of said rear head remote from said rotor, for adjusting the degree of elasticity of said bellows.

10. In a variable capacity vane compressor including:

a clutch;

a cylinder formed of a cam ring and a pair of a front side block arranged close to said clutch and a rear side block arranged remote from said clutch, said front and r ®ar side blocks closing opposite ends of said cam ring, said cylinder having at least one first inlet port formed therein, a rotor rotatably received within said cylinder, and a plurality of vanes radially slidably fitted in respective slits formed in said rotor; and a housing defining a suction chamber therein, said housing having a rear head at a side of said rear side block remote from said rotor, a driving shaft on which said clutch and said rotor are secured, said driving shaft extending through said front side block, and power transmitting means mounted on said driving shaft at a side of said front side block remote from said rotor; and wherein compression chambers are defined between said cylinder, said rotor and adjacent ones of said vanes and said compression chambers varying in volume with rotation of said rotor for effecting suction of a compression medium from said suction chamber into said compression chambers through said at least one first inlet port, and compression and discharge of said compression medium;

the improvement comprising:

at least one second inlet port formed in said rear side block and adjacent a corresponding first inlet port, said at least one second inlet port extending circumferentially and communicating said suction chamber with at least one of said compression chambers which is on a suction stroke;

an annular opening angle control element arranged in said rear side block at an end face of said rear side block facing said rotor and coaxially with said driving shaft for rotation about an axis of said driving shaft, said annular opening angle control element being so disposed that a circumferential position thereof determines the opening angle of said at least one second inlet port, said annular opening angle control element having a radially extending pressure receiving portion integrally formed on an end face thereof remote from said rotor and defining a first pressure chamber communicating with a high pressure side to be supplied with discharge pressure therefrom and a second pressure chamber communicating with said suction chamber to be supplied with a suction pressure from said suction chamber, said first pressure chamber being supplied with a back pressure acting upon radially inner end faces of each of said vanes, said first and second pressure chambers being arranged in said rear side block circumferentially of said control element, said pressure receiving portion being angularly displaceable in response to a difference between pressure in said first pressure chamber and pressure in said second pressure chamber for causing said opening angle control means to vary the opening angle of said at least one second inlet port;

biasing means for urging said annular opening angle control element in a direction in which the opening angle to said at least one second inlet port is increased; and pressure control means arranged in said rear side block and said rear head and being responsive to at least one parameter representative of a thermal load on said compressor for varying at least one of the pressure in said first pressure chamber and the pressure in said second pressure chamber, whereby a change in the opening angle of said at least one second inlet port causes a change in the timing of commencement of the compression of the compression medium.

* * * * *

UNITED STATES PATENT AND TRADEMARK OFFICE

CERTIFICATE OF CORRECTION

PATENT NO. : 4,818,189

DATED : April 4, 1989

INVENTOR(S) : Nakajima, N.

It is certified that error appears in the above-identified patent and that said Letters Patent is hereby corrected as shown below:

Column 10, line 51, "f" should read --of--.

Column 12, line 64, "pressure" should read --pressures--.

Column 12, line 65, "detecter" should read --detected--.

Column 13, line 32, "r®ar" should read --rear--.

Signed and Sealed this

Seventeenth Day of July, 1990

*Attest:*

HARRY F. MANBECK, JR.

*Attesting Officer*

*Commissioner of Patents and Trademarks*